United States Patent [19]

Jewett, Sr., deceased

[11] Patent Number: 4,977,675

[45] Date of Patent: Dec. 18, 1990

[54] APPARATUS FOR MARKING EYEGLASS LENS BLANKS

[75] Inventor: Bryce D. Jewett, Sr., deceased, late of Richmond, Va., by Bryce D. Jewett, Jr., executor

[73] Assignee: Rxtec, Incoporated, Richmond, Va.

[21] Appl. No.: 336,683

[22] Filed: Apr. 12, 1989

[51] Int. Cl.[5] ..... B43L 11/00; G01B 1/00

[52] U.S. Cl. ..... 33/028; 33/507

[58] Field of Search ..... 33/507, 28, 200; 51/277, 284 R, 284 S

[56] References Cited

U.S. PATENT DOCUMENTS

| | | | |
|---|---|---|---|
| 2,290,566 | 7/1942 | Lockhart . | |
| 2,917,971 | 12/1959 | Goddu et al. | 33/507 |
| 3,242,581 | 3/1966 | Wagéner | 33/507 |
| 3,368,285 | 2/1968 | Buckminster et al. | 33/507 |
| 3,737,238 | 6/1973 | Reiner et al. . | |
| 4,115,924 | 9/1978 | Kleinkopf | 33/507 |
| 4,169,318 | 10/1979 | Cortes . | |
| 4,319,846 | 3/1982 | Henry et al. . | |
| 4,330,203 | 5/1982 | Oppenheim et al. . | |
| 4,479,332 | 10/1984 | Stern et al. | 33/507 |
| 4,676,004 | 6/1987 | Nakamura et al. | 33/507 |

*Primary Examiner*—William A. Cuchlinski, Jr.
*Assistant Examiner*—Christopher W. Fulton
*Attorney, Agent, or Firm*—Norman B. Rainer

[57] ABSTRACT

Apparatus is provided for marking a semi-finished opthalmic lens blank for a subsequent blocking operation. The marking serves to indicate the optical center, cylindrical axis, and prism axis. The apparatus has a vertically positionable head assembly having a centered set of three holders for marking pens and an outer holder for a marking pen. An illumination head, located between the pen holders and the blank, facilitates proper orientation of the blank in preparation for marking. By way of a single activation command, such as the pressing of a button, the head assembly begins its downward descent to mark the blank and the illumination head swings aside, and both components are automatically restored to their previous, resting positions.

7 Claims, 3 Drawing Sheets

APPARATUS FOR MARKING EYEGLASS LENS BLANKS

BACKGROUND OF THE INVENTION

This invention relates to an instrument for marking a semi-finished opthalmic lens blank for a subsequent blocking operation, said marking serving to indicate the optical center, cylindrical axis, and prism axis of the lens.

Opthalmic lenses are generally made from blanks formed from glass or plastic. The convex front surface of the blank is already finished. The back, eye-side surface of the blank is generally concave. The further concave toric surfaces required under prescriptions for astigmatism are thereafter ground into the back surface in compliance with the prescription.

In preparation for the grinding operation, the convex surface of the blank is mounted upon a retaining member known as a lens block which adheres to the blank by virtue of contact adhesive, a vacuum cup, or poured-in-place low melting temperature alloy. The lens blank and block assembly is then accurately mounted in a lens generating apparatus such as disclosed in U.S. Pat. No. 4,769,953 wherein a prescriptive surface is ground into the back surface as a cylinder cut comprised of a base curve whose curvature is based upon the length of a swing arm that sweeps a rotating grinding wheel across the lens surface, and a cross curve whose curvature is dependent upon the radius of the wheel and its angle with respect to the lens. The base curve intersects the optical center of the lens, namely the center determined by the patient's interpupillary distance. The base and cross curves are accordingly perpendicular to each other. The axis upon which the base curve is centered is generally referred to as the cylindrical axis.

In certain opthalmic lens prescriptions wherein there is need to correct a vision problem known as diplopia, the lens thickness is tapered from the perimeter inward, producing an attendant gradient of magnifying power. Such adjustment of the lens thickness is generally accomplished by utilizing a wedge to space the block from the lens. The axis upon which the wedge is centered relative to the optical center of the lens is referred to as the prism axis.

Following the grinding step, the lens is further lapped and polished, and the perimeter is bevelled or otherwise modified to permit fitting into an eyeglass frame.

It is important that the block lie accurately mounted upon the lens blank to ensure precise formation of the final lens product. Devices have earlier been disclosed for placing removable ink marks upon the convex surface to indicate the requisite positioning of the block. Such devices however, have generally required several manipulative steps, causing relatively high costs in terms of the increased time required of the technicians who operate the marking devices.

In particular, earlier marking devices have generally required a first step wherein the lens blank is carefully positioned upon a transparent target reticle plate while viewed by an illumination system that projects light through the reticle and lens blank. In a second step, positional adjustments are made in marking pens. In a third step, the illumination system or portion thereof is displaced to a location where it will not interfere with the function of the marking pens. In a fourth step, the marking pens are caused to move in a vertical path to place marks upon the convex surface. In a fifth step, the apparatus is restored to its starting configuration for use upon the next lens blank. In many marking devices, further additional steps are required to separately locate and mark the optical center, cylinder axis, and prism axis. In some marking devices, the cylinder axis is defined by two separated dots disposed on opposite sides of a dot representing the optical center, the three dots lying on a straight line. However, it is found preferable for the purpose of accurate placement of the block to have lines instead of separated dots for establishing the cylinder axis.

It is accordingly an object of the present invention to provide apparatus for the rapid and accurate determination and marking of the optical center, cylinder axis, and prism axis of an opthalmic lens blank.

It is a further object of this invention to provide apparatus as in the foregoing object wherein the marking is produced on the finished front convex surface of said lens blank in a manner to facilitate precise attachment of a holding block.

It is a another object of the present invention to provide apparatus of the aforesaid nature which achieves said marking in a single step, and presents said cylinder axis and prism axis as lines radially oriented with respect to the optical center of the lens.

These objects and other objects and advantages of the invention will be apparent from the following description.

SUMMARY OF THE INVENTION

The above and other beneficial objects and advantages are accomplished in accordance with the present invention by an apparatus comprising:

(a) an upright housing having upper and lower extremities, a front surface, and left and right side panels, (b) a hollow base, upon which the lower extremity of said upright housing is mounted, (c) track means associated with the front surface of said upright housing, (d) a head assembly vertically positionable by slidable engagement with said track means, said head assembly being comprised of:

(1) first and second rotatable circular cylindrical sleeves positioned one above the other upon a common vertical center axis, each provided with a scale of angular degree markings, (2) set of three holders for marking pens disposed below said sleeves in side-by-side relationship, the center of said three holders being centered upon said vertical axis, the two outermost of said three holders having pivotal mobility permitting movement in divergent radial directions with respect to said center holder, said set of three holders being rotatable about said vertical axis by movement of said first sleeve, (3) a fourth holder for a marking pen mounted below said circular sleeves and adapted to travel in a circular path about said set of three holders and centered upon said vertical axis, said travel movement being coupled to said second sleeve, said forth holder having pivotal mobility permitting movement in an arc centered in a plane containing said vertical axis, (e) stage mounted upon said base beneath said head assembly and having controlled movability in a horizontal plane, (f) transparent alignment means comprising a first reticle having inscribed thereupon concentric circles, and a second reticle having a series of parallel lines inscribed thereupon, said reticles being disposed one above the other in horizontal planes, (g) positioning means which dispose a lens blank above said alignment means, (h) viewing means comprising:

(1) an illumination head located between said head assembly and stage in a resting position centered upon said vertical axis, and adapted to swing in a horizontal path away from said resting position, and (2) a port in said base which permits viewing of an image of the lens blank in association with the alignment means, (i) mechanical means disposed within said upright housing for moving the head assembly up and down upon said track means, (j) mechanical means for causing swinging movement of said light reflecting means, and (k) electrical control means which, by way of a single activation command, cause the illumination head to swing away from its resting position, and causes downward movement of the head assembly, which effects marking of the lens blank, and returns said head assembly to the upward starting position and said illumination head to its resting position.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
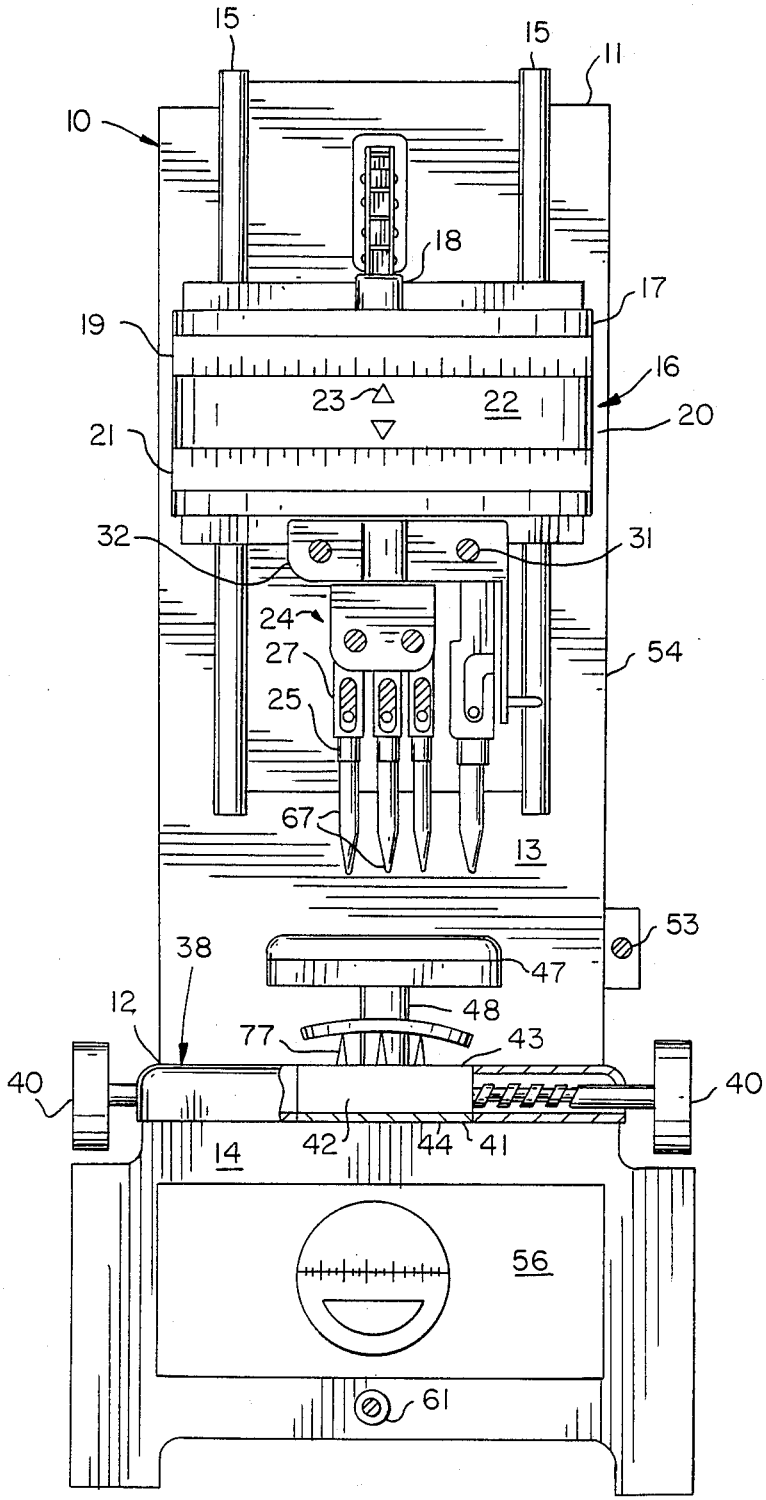
FIG. 1 is a front view of an embodiment of the apparatus of the present invention with portions broken away to reveal interior details.

Referring to FIGS. 1–4, an embodiment of the apparatus of the present invention is shown comprised of upright housing 10 having upper and lower extremities 11 and 12, respectively, and front surface 13, and base 14 upon which the upright housing is mounted in vertical disposition. Track means in the form of paired vertical cylindrical rods 15 are affixed to said front surface 13.

A head assembly 16 having a channelled mounting block 79 is adapted to slidably engage said track means for controlled reciprocal movement in a vertical path. The head assembly is vertically penetrated by a centered post 18 adapted to rotate upon a vertical axis 68. An upper, first circular cylindrical sleeve 17 of disc-like configuration is centrally affixed to post 18 in a manner permitting 360 degree rotation in a horizontal plane. The perimeter of sleeve 17 contains a series of parallel vertical rulings 19 which indicate circular degrees of rotation. A lower, second circular cylindrical sleeve 20 of disc-like configuration is disposed below said first sleeve in coaxial disposition therewith and adapted to rotate 360 degrees in a horizontal plane around post 18. As in the case of the first sleeve, the perimeter of the second sleeve contains ruled indicia 21 for establishing positioning criteria. Both sleeves are separated by a non-rotating barrel portion 22 of the head assembly. A reference mark 23 on the forwardly directed region of barrel portion 22 establishes the zero point of reference for rulings 19 and 21.

A set 24 of three holders for marking pens is held by block 29 disposed upon the lowermost extremity of post 18 and below second sleeve 20. Said three holders are in side-by-side relationship, each having an upper portion 69 housing a coil spring 26, and a telescoping lower socket portion 70 adapted to accommodate the top of a marking instrument such as a felt-tipped pen 67 or equivalent marking device. The center holder 25 of said set is centered upon said vertical axis. The two outermost holders 27 of said three-holder set pivot about mounting pins 28, permitting divergent movement in arcs radially disposed to said axis. The springs 26 are adapted to urge the respective socket portion downward while permitting about ½ inch of reciprocal motion. Restoring springs, not shown, may be associated with the upper portions of outermost holders 27 to bias said holders to a vertical position. The set 24 of three holders is rotatable as a unit about said vertical axis by movement of said first, upper sleeve.

A fourth, outer holder 30 for a marking pen is mounted by pivot pin 31 upon collar 32 which is rotatably positioned upon post 18 and attached to the underside 37 of said lower sleeve. Holder 30 is comprised of upper portion 71, which houses coil spring 26, and a telescoping lower socket portion 72 adapted to accommodate a felt-tipped pen. By virtue of its manner of mounting, said fourth holder can be moved circularly with respect to said axis and about the set of three holders, and can also swing in an arc radially disposed to said axis. The coil spring 26 urges the socket portion downward, permitting about ½ inch of reciprocal motion. The arc-like swinging movement of holder 30 away from its vertical position is resisted by laterally positioned coil spring 34 confined within enclosure 35 attached to arm 36 affixed to collar 32. Accordingly, spring 34 biases holder 30 in its vertical position.

Figure 2:
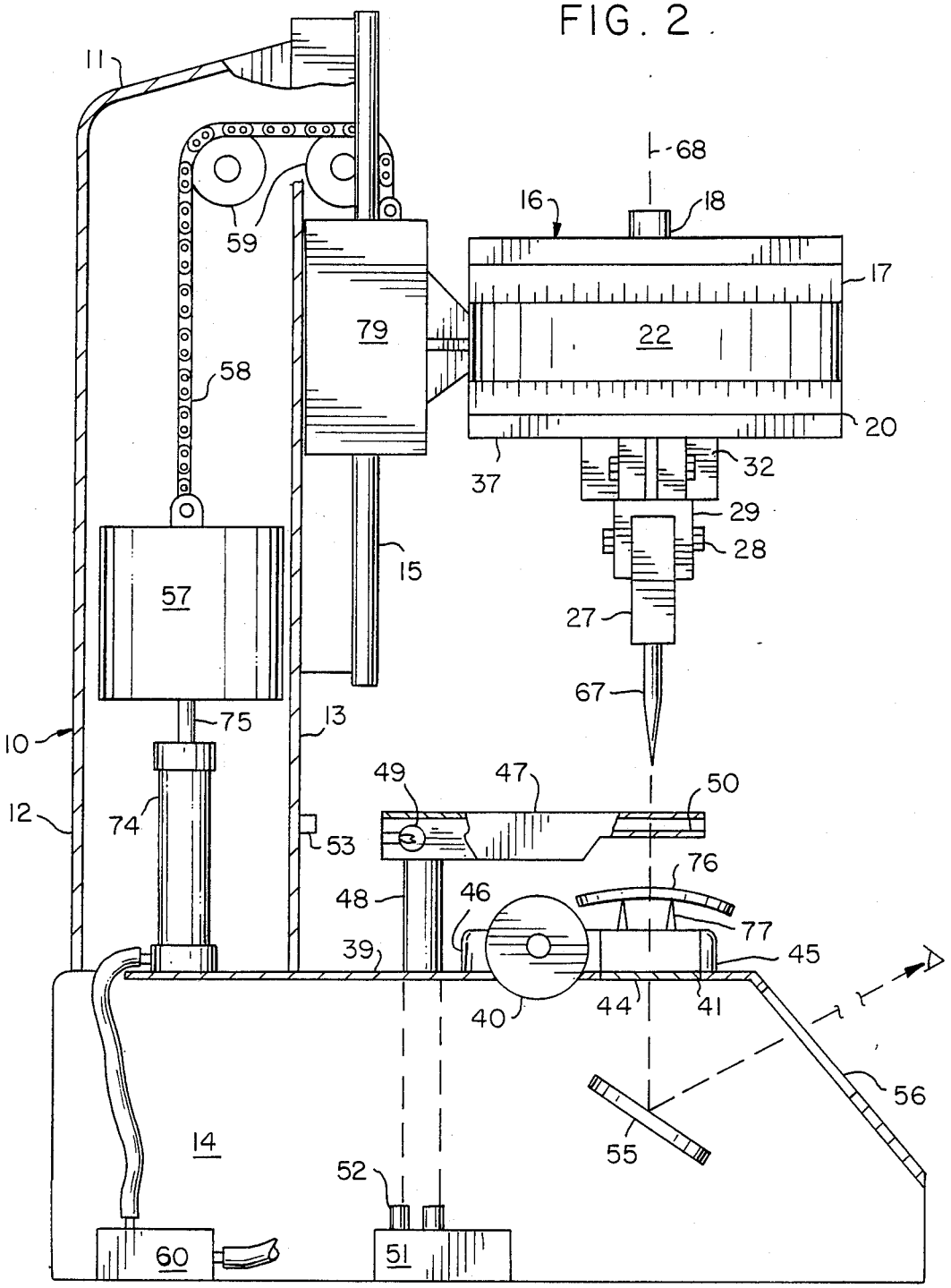
FIG. 2 is a left side view with portions broken away.
Figure 3:
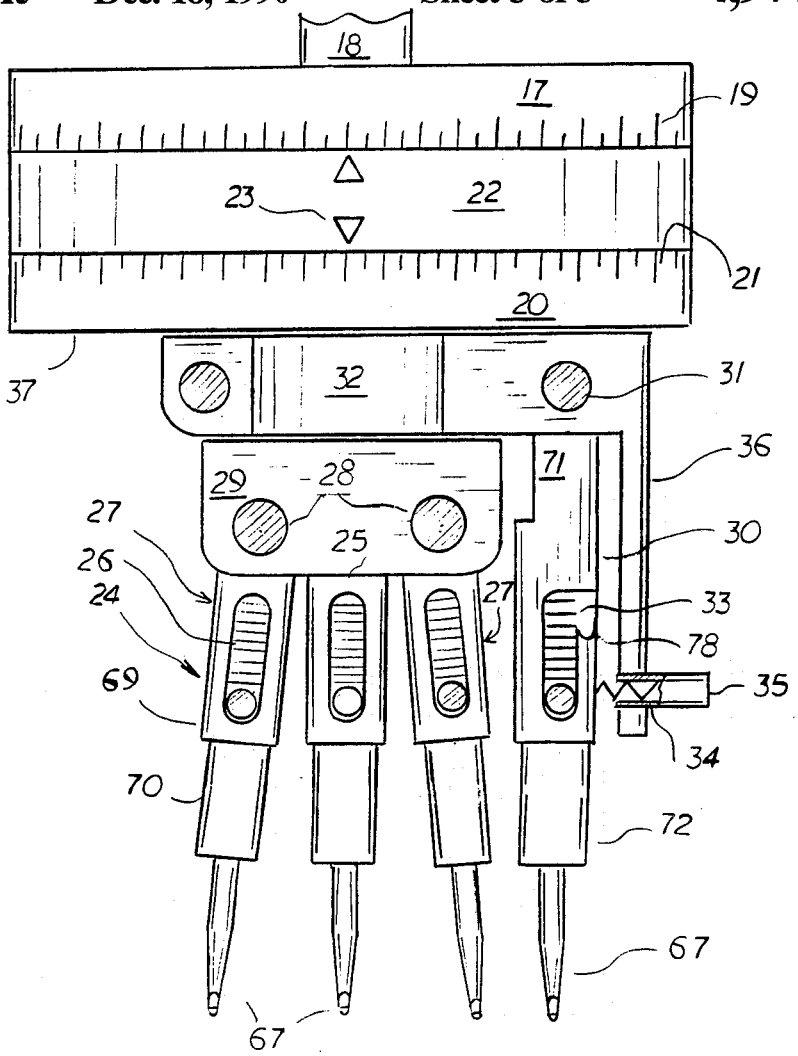
FIG. 3 is an enlarged fragmentary front view.
Figure 4:
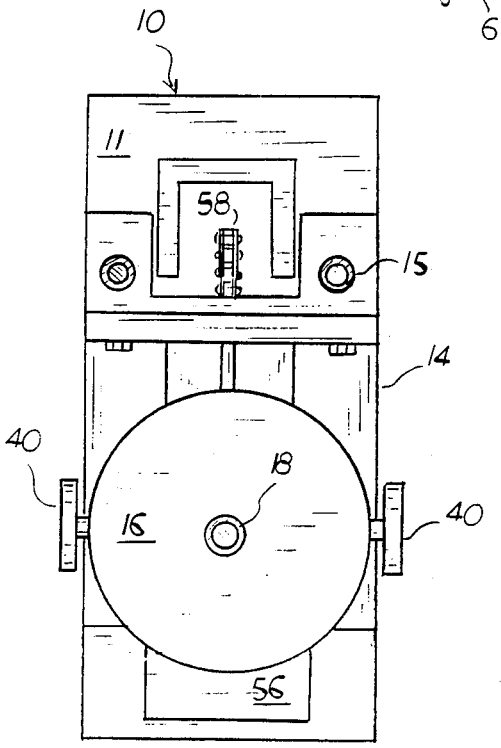
FIG. 4 is a top view of the apparatus of FIG. 1.
Figure 6:
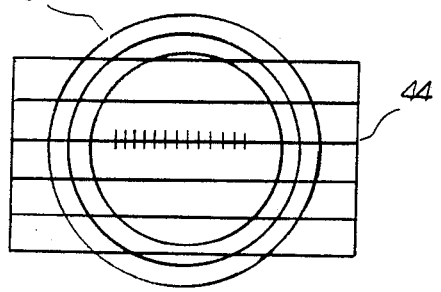
FIG. 6 is a plan view of the transparent alignment means.

As best shown in FIGS. 1 and 2, a stage 38 having front and rear extremities 45 and 46, respectively, is positioned upon the upper surface 39 of base 14 above aperture 41 in said upper surface. The stage is movable in a horizontal plane upon surface 39 by virtue of a conventional worm gear rack and pinion mechanism manipulated by knobs 40. A frame 42 is recessed into the upper surface of stage 38. First transparent reticle 43 movable with stage 38 and containing a series of concentric circles is seated within frame 42. Second reticle 44, having one series of parallel lines oriented in the direction between the front and rear extremities of stage 38 and a second, perpendicular series of lines, is seated below reticle 43 immovably attached to base 14. When viewed from above, as shown in FIG. 6, the reticles, which constitute an alignment means, are seen as a series of parallel lines intersecting a series of concentric circles.

Positioning means in the form of three upwardly tapered posts 77 fabricated of stiffly resilient materials and positioned equiangularly upon a circular locus are disposed upon reticle 43. Said posts are adapted to receive the concave eye-side surface of lens blank 76, thereby securely supporting the blank during its positioning and subsequent marking. By virtue of the aforesaid arrangement of components, the lens blank is immovable with respect to first retical 43 but movable with respect to second reticle 44.

An illumination head 47 is rotatably mounted upon post 48 extending upwardly through upper surface 39 of base 14. Enclosed within head 47 is an incandescent light bulb 49, and light-diffusing plate 50 positioned above reticles 43 and 44. The lowermost extremity of post 48, disposed within base 14, is associated with pneumatically operated drive means 51 capable of turning post 48 upon its axis to about 90 degrees of circular arc. Said turning motion of post 48 is resisted by spring means 52, which returns said post to its starting position when drive means 51 is de-activated. The de-activation of drive means 51 is accomplished by switch 53 mounted upon right side panel 54 of said upright housing. Said switch is placed in a manner such that illumination head 47, at the end of its rotation in a horizontal path, contacts the switch. Such action initiates return of illumination head 47 to its resting position above the reticles. Resilient shock-absorbing means are suitably emplaced to minimize any jarring effects to illumination head 47 at both extremities of its rotative travel.

Light emitted from illumination head 47 travels downwardly through the lens blank and two reticles, thence through aperture 41 and onto reflecting mirror 55 which directs the light through front viewing port 56 to the eyes of the operator. By virtue of such viewing means, the operator of the apparatus can clearly see the lens blank in this association with the reticles. Such view enables the operator to make appropriate manipulative adjustments of the lens blank by rotating either knob 40.

A pneumatically activated cylinder 74 equipped with output drive rod 75 is positioned within upright housing 10. A counterweight 57 is disposed atop rod 75 and adapted to undergo reciprocal sliding movement within said housing. A sprocket chain 58 attached to the top of counterweight 57 extends upwardly to engagement with paired sprocket wheels 59 and thence emerges from the housing and is downwardly directed to attachment with head assembly 16. An electrically operated solenoid valve 60 controls admission of pressurized air to cylinder 74.

A push-button electrical switch 61 is positioned below front view port 56. When depressed by the operator, cylinder 74 is pressurized to initiate downward motion of head assembly and synchronized rotation of illumination head 47 toward right side panel 54, where it is out of the way of the downward path of the head assembly. Electrical contacts located adjacent the most downward position of the head assembly de-activate cylinder 74, thereby enabling counterweight 57 to restore the head assembly to its uppermost, resting position.

Figure 5:
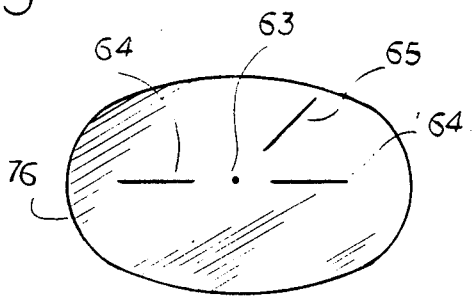
FIG. 5 is a plan view of the convex surface of a lens blank marked by the apparatus of this invention.

In the operation of the apparatus, a semi-finished opthalmic lens blank is placed upon positioning means 77 in a manner such that the concave surface is downwardly directed, and the circular perimeter of the blank is concentric with the circles inscribed in the first reticle. The lens blank thusly supported is horizontally displaced by manipulation of knob 40 until the vertical center axis of the apparatus is aligned by virtue of said alignment means with the optical center of the blank corresponding with the prescribed interpupillary distance. Sleeve 17 is then rotated to an angular position, indicated by reference mark 23, corresponding to the angle of the cylindric lens axis. Similarly, sleeve 20 is rotated to indicate the prism axis. Switch 61 is then depressed. This causes illumination head 47 to swing aside and head assembly 16 to descend. At the bottom of the descent, the felt tip ink marker pens 67 contact the upwardly directed convex surface of the lens blank. The pen held by center holder 25 imprints a dot 63, as shown in FIG. 5, representing the optical axis. The pens in holders 27 draw lines 64 which represent the cylinder axis, and the pen held by holder 30 draws a straight line 65 which represents the prism axis. The thusly marked lens blank is then removed and forwarded to a block-applying operation where the block is accurately emplaced by virtue of the markings on the convex surface of the blank.

A lock-out shoulder 78 is provided in holder 30 to permit lower socket portion 72 to be elevated, thereby deactivating the pen held by said socket portion. This feature is utilized when the particular lens being fabricated does not require a prism axis.

In an alternative embodiment of the invention, the holders 27 are adapted to make a dot instead of a line on the lens blank. This is achieved by eliminating the pivoting lateral motion enabled by mounting pins 28.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for marking a semi-finished ophthalmic lens blank for a subsequent blocking operation, said marking serving to indicate the optical center, cylindrical axis and optionally the prism axis of the lens, said apparatus comprising:

(a) an upright housing having upper and lower extremities, a front surface, and left and right side panels, (b) a hollow base, upon which the lower extremity of said upright housing is mounted, (c) track means associated with the front surface of said upright housing, (d) a head assembly vertically positionable by slidable engagement with said track means, said head assembly being comprised of:

(1) first and second rotatable circular cylindrical sleeves positioned one above the other upon a common vertical center axis, each provided with a scale of angular degree markings, (2) a set of three holders for marking pens disposed below said sleeves in side-by-side relationship, the center of said three holders being centered upon said vertical axis, the two outermost of said three holders having pivotal mobility permitting movement in divergent radial directions with respect to said center holder, said set of three holders being rotatable about said vertical axis by movement of said first sleeve, (3) a fourth holder for marking pen mounted below said circular sleeves and adapted to travel in a circular path about said set of three holders and centered upon said vertical axis, said travel movement being coupled to said second sleeve, said forth holder having pivotal mobility permitting movement in an arc centered in a plane containing said vertical axis, (e) a stage mounted upon said base beneath said head assembly and having controlled movability in a horizontal plane, (f) transparent alignment means comprising a first reticle having inscribed thereupon concentric circles, and a second reticle having a series of parallel lines inscribed thereupon, said reticles being disposed one above the other in horizontal planes, and moveable with respect to each other within said planes, (g) positioning means which dispose a lens blank above said alignment means, (h) viewing means comprising:

(1) an illumination head located between said head assembly and stage in a resting position centered upon said vertical axis, and adapted to swing in a horizontal path away from said resting position, and (2) a port in said base which permits viewing of an image of the lens blank in association with the alignment means, (i) mechanical means disposed within said upright housing for moving the head assembly up and down upon said track means, (j) mechanical means for causing swinging movement of said light reflecting means, and (k) electrical control means which, by way of a single activation command, cause the illumination head to swing away from its resting position, and causes downward movement of the head assembly, which effects marking of the lens blank, and returns said head assembly to the upward starting position and said illumination head to its resting position.

2. The apparatus of claim 1 wherein said mechanical means for moving the head assembly up and down utilize pneumatically operated drive means.

3. The apparatus of claim 1 wherein said mechanical means for causing swinging movement of said light reflecting means utilize pneumatically operated drive means.

4. The apparatus of claim 1 wherein each holder of said set of three holders has an upper portion which houses a coil spring, and a telescoping lower socket portion adapted to accommodate a marking instrument.

5. The apparatus of claim 1 wherein said fourth holder has an upper portion which houses a coil spring, and a telescoping lower socket portion adapted to accommodate a marking instrument.

6. The apparatus of claim 1 wherein spring means bias said fourth holder toward a vertical disposition.

7. The apparatus of claim 1 wherein means are provided to deactivate said fourth holder.

* * * * *